US005494410A

United States Patent [19]

Maier-Laxhuber et al.

[11] Patent Number: 5,494,410

[45] Date of Patent: Feb. 27, 1996

[54] MANUALLY OPERABLE VACUUM PUMP

[75] Inventors: Peter Maier-Laxhuber, Unterschleissheim; Andreas Becky, München; Gerald Heggl, Inning, all of Germany

[73] Assignee: Zeo-Tech GmbH, Unterschleissheim, Germany

[21] Appl. No.: 197,682

[22] Filed: Feb. 17, 1994

[30] Foreign Application Priority Data

Feb. 17, 1993 [DE] Germany ..... 43 04 786.6

[51] Int. Cl.[6] ..... F04B 53/12; F04B 25/00

[52] U.S. Cl. ..... 417/53; 417/259; 417/523; 417/545

[58] Field of Search ..... 417/259, 523, 417/545, 547, 553

[56] References Cited

U.S. PATENT DOCUMENTS

| | | | |
|---|---|---|---|
| 660,136 | 10/1900 | Welch | 417/259 |
| 1,498,471 | 6/1924 | Miller | 417/259 |
| 1,682,736 | 9/1928 | Berry | 417/553 |
| 2,006,583 | 7/1935 | Dennison | 417/553 |
| 3,282,220 | 11/1966 | Inman | 417/259 |
| 3,485,180 | 12/1969 | Wickenberg et al. | 417/553 |
| 3,752,604 | 8/1973 | Dorn | 417/553 |
| 3,753,518 | 8/1973 | Kutik | 417/553 |
| 4,975,028 | 12/1990 | Schultz | 417/553 |

*Primary Examiner*—Richard A. Bertsch
*Assistant Examiner*—Peter G. Korytnyk
*Attorney, Agent, or Firm*—Hoffman & Baron

[57] ABSTRACT

A manually operable vacuum pump having a housing including first and second pump chambers whose volume is altered by movement of a displaceable piston which is moved by means of a piston rod attached thereto and fed through one of the first and second pump chambers. The first and second pump chambers are configured such that gas which is fed into the vacuum pump is compressed in two steps, primarily in the first pump chamber and secondarily in the second pump chamber to provide a suitable endvacuum. Thereafter, the gas is expelled from the second pump chamber through the second end cap.

10 Claims, 1 Drawing Sheet

MANUALLY OPERABLE VACUUM PUMP

BACKGROUND OF THE INVENTION

1. Field of the Invention

The present invention relates to vacuum pumps, and more particularly relates to vacuum pumps for removing air from relatively small containers.

2. Description of the Prior Art

Electrically driven vacuum pumps are known in the prior art. However, these vacuum pumps tend to be relatively expensive and are not capable of operation without a source of electric power. In addition to electric vacuum pumps, manually operable (i.e. manually driven) vacuum pumps are known, specifically for laboratory use. Manually operable vacuum pumps commonly utilize a single step process to achieve a suitable endvacuum. Typically, the manually operable vacuum pumps produce an endvacuum of approximately 0.3 Psi absolute.

German patent number DE 4,138,114 discloses a sorption cooling system including sorption medium which, under vacuum conditions, adsorbs steam from a water reservoir. As a result of the adsorption of steam, the liquid which remains in the water reservoir cools and may even solidify to form ice. Typically, in order for the water to cool to 0° C. and solidify, a vacuum pressure of approximately 0.08 Psi should be present within the sorption cooling system. Ideally, a manually operable vacuum pump should easily and quickly provide a suitable vacuum pressure throughout the entire sorption cooling system. However, presently known manually driven vacuum systems are incapable of easily and efficiently removing air from a connected sorption cooling system or other device.

OBJECTS AND SUMMARY OF THE INVENTION

It is an object to the present invention to provide a manually operable vacuum pump which is inexpensive, simple to use, easily transportable and is capable of providing an endvacuum of approximately 0.08 Psi.

It is a further object of the present invention to provide a manually operable vacuum pump which overcomes the inherent disadvantages of known manually operable vacuum pumps.

In accordance with one form of the present invention, a manually operable vacuum pump preferably includes a housing having first and second pump chambers. The housing includes walls which have interior and exterior surfaces wherein the interior surface of the housing walls at least partially define the first and second vacuum pump chambers. The first and second vacuum pump chambers are also respectively defined by first and second end caps and a displaceable piston which is contained within the housing. The first and second pump chambers define first and second chamber volumes respectively.

The first chamber volume of the first pump chamber and the second chamber volume of the second pump chamber may be altered in accordance with movement of the displaceable piston. The displaceable piston is coupled to a piston rod which is fed through the first or second pump chamber and the first or second end cap.

The position of the displaceable piston is altered by moving the piston rod which is coupled thereto. The first pump chamber is preferably in selectable fluid communication with the second pump chamber such that gas that is provided to the vacuum pump is compressed in two stages, primarily in the first pump chamber and secondarily in the second pump chamber to provide a suitable endvacuum. Therefore, the gas is expelled from the second pump chamber through the second end cap.

A preferred form of the manually operable vacuum pump and method for utilizing the same, as well as other embodiments, objects, features and advantages of this invention, will be apparent from the following detailed description of illustrative embodiments thereof, which is to be read in connection with the accompanying drawings.

DETAILED DESCRIPTION OF THE PREFERRED EMBODIMENTS

Figure 1A:
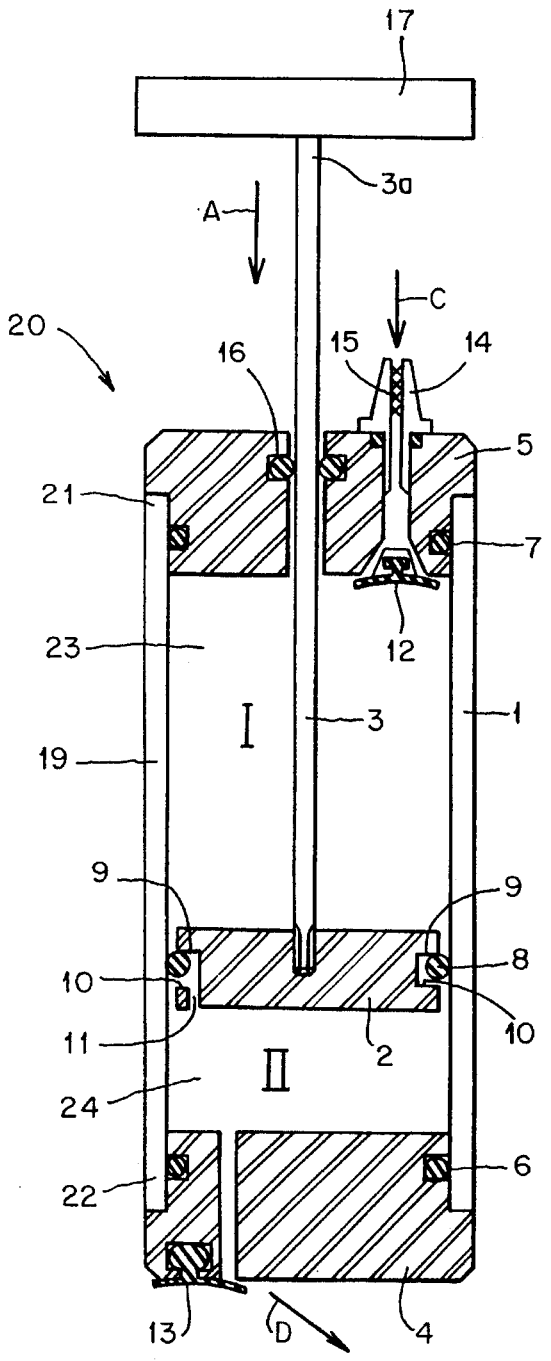
FIG. 1A is a cross-sectional view of the manually operable vacuum pump of the present invention showing a piston and piston rod being moved within a housing in a direction indicated by arrow A.
Figure 1B:
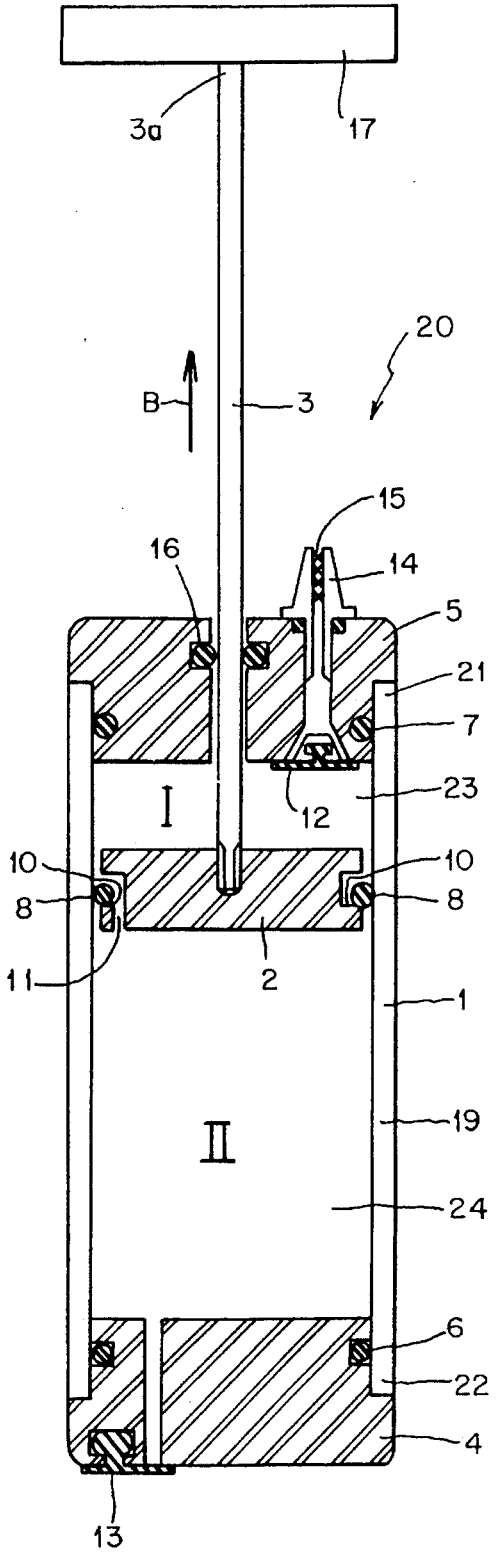
FIG. 1B is a cross-sectional view of the manually operable vacuum pump of the present invention showing a piston and piston rod being moved within a housing in a direction indicated by arrow B.

Referring now to FIGS. 1A and 1B of the drawings, a manually operable vacuum pump constructed in accordance with the present invention will now be described. The vacuum pump of the present invention is designed such that a two-step compression process is employed so as to provide a desired end pressure of the vacuum pump.

In accordance with the present invention, vacuum pump 20 includes a pump housing 19 having a generally cylindrical pipe 1 with a substantially hollow interior region. Piston 2 is slideably mounted within the interior region of the cylindrical pipe. Coupled to the piston 2 is a piston rod 3 which is utilized to move the piston throughout the interior region of the cylindrical pipe. The pump housing 19 includes first and second end caps 5, 4 and first and second 0-rings 7, 6. The first and second end caps 5,4 and first and second O-rings 7,6 are respectively attached to first and second ends 21,22 of the cylindrical pipe in a vacuum tight manner so as to substantially air-tight seal the interior region of the cylindrical pipe. The cylindrical pipe, first end cap and piston define a first pump chamber within the interior region of the cylindrical pipe. Additionally, the cylindrical pipe, second end cap and piston define a second pump chamber within the interior region of the cylindrical pipe. The first and second end caps 5,4 preferably respectively includes a suction valve 12 and an exhaust valve 13. The suction valve 12 is preferably a one way valve which permits the introduction of gas through the first end cap 5, but which substantially prevents the removal of gas from the first pump chamber through the first end cap. The exhaust valve 13 is also preferably a one-way valve which permits the expulsion of gas from the second pump chamber through the second end cap but substantially prevents the introduction of gas into the second pump chamber through the second end cap.

As previously mentioned the piston 2 of the vacuum pump substantially divides the interior region of the vacuum pump defined by the cylindrical pipe and first and second end caps into first and second pump chambers 23,24 having respective first and second pump chamber volumes. The first and second pump chamber volumes are preferably in selectable fluid communication with each other. The piston 2 utilized in the present invention preferably includes an O-ring 8, first sealing face 9, second sealing face 10 and bore 11. As previously mentioned, as piston 2 is slideably moved by piston rod 3, the first and second pump chamber volumes are altered. Referring specifically to FIG. 1A, as piston rod 3 is moved in the direction indicated by arrow A (i.e. toward the second end cap of the vacuum pump), the volume of the first chamber 23 increases in size while, simultaneously, the volume of the second chamber 24 decreases. Likewise, referring to FIG. 1B, as piston rod 3 is moved in the direction indicated by arrow B, the volume of the first chamber 23 decreases while, simultaneously, the volume of the second chamber 24 increases.

The piston rod 3 is preferably slideably mounted through first end cap 5 such that an end 3*a* of the piston rod, which is unattached to the piston, remains outside the interior region of the vacuum pump. Coupled to the end 3*a* of the piston rod is a handle 17 for assisting in the manipulation of the position of the piston within the interior region of the vacuum pump. Alternatively, a foot pedal can be substituted for the handle so that the piston can be manipulated by movements of a user's foot. The piston rod 3 is preferably air-tight slideably mounted to the first end cap 5 by means of O-ring 16 which is contained within the first end cap 5 and which contacts the piston rod 3.

The vacuum pump of the present invention is configured such that when the piston 2 is moved in the direction indicated by arrow A as shown in FIG. 1A, the O-ring 8 engages the first sealing face 9 so as to substantially eliminate fluid communication between the first and second pump chambers 23,24. However, when the piston 2 is moved in the direction indicated by arrow B as shown in FIG. 1B, O-ring 8 is separated from the first sealing face 9. This is preferably caused by friction between the O-ring 8 and the interior of cylindrical pipe 1 so that the O-ring is pushed onto second sealing face 10. In this orientation, fluid communication between the first and second pump chambers 23,24 is accomplished via bore 11 through piston 2. As a result of the above-identified configuration, when the volume of the first pump chamber is reduced, gas can exit the first pump chamber and enter the second pump chamber. During this process wherein gas is provided from the first pump chamber to the second pump chamber, the pressure within the first and second pump chambers is substantially the same because the suction valve 12 in the first end cap and the exhaust valve 13 in the second end cap are substantially closed.

When the piston 2 is moved in the direction indicated by arrow A as shown in FIG. 1A, the volume of the first pump chamber is increased. As a result, suction valve 12 is opened and provides gas through suction socket 14 as shown by arrow C of FIG. 1A. The suction valve 12 preferably includes a relatively fine air filter for removing foreign matter particles from the gas before it enters the first pump chamber. As a further result of the movement of the piston 2 in the direction indicated by arrow A, the gas in the second pump chamber is compressed until a sufficient pressure is achieved to open exhaust valve 13 and release the gas as indicated by arrow D of FIG. 1A.

Referring to FIGS. 1A and 1B, when the displaceable piston 2 is moved in the direction indicated by arrow B such that the piston is substantially incapable of being moved closer to the first end cap, the second chamber volume is traditionally denoted as a "chamber volume" ($V_o$). However, when the displaceable piston 2 is moved in the direction indicated by arrow A such that the piston is substantially incapable of being moved farther away from the first end cap, the second chamber volume is traditionally denoted as a "clearance volume" ($V_c$). Stated another way, the second chamber volume is representative of the chamber volume ($V_o$) when the piston is moved to its closest position to the first end cap and the second chamber volume is representative of the clearance volume ($V_c$) when the piston is moved to its closest position to the second end cap. The present invention is specifically designed such that the pressure ($p_c$) in the clearance volume and the pressure ($p_o$) in the chamber volume follow the well-known equation $p_cV_c=p_oV_o$ known as the ideal gas law. Therefore, if the piston rod is provided into the first pump chamber such that the piston is proximate to the second end cap, and if the clearance volume pressure $p_c$ is substantially atmospheric pressure, the pressure $p_c$ in the clearance volume will decrease as the piston is pulled toward the first end cap. In order to provide a pressure which is less than 0.08 Psi in a device that is coupled to suction socket 14, the ratio between the clearance volume and the chamber volume needs to be given a value which is dependant on the initial pressure. Therefore, if $p_c$ is measured to be 14.5 Psi and if $p_o$ is desired to be approximately 0.08 Psi, the ratio $p_c/p_o$ is 181. As a result, if $V_o$ is measured to be 181 $in^3$, then $V_c$ should be at most 1 $in^3$.

As explained above, in order to provide a required or desired endpressure, a two step compression of the vacuum pump in accordance with the present invention is preferable. In accordance with the operation of the invention, piston 2 is moved within the pump housing in such a manner that it separates the housing into first and second pump chambers such that as the position of the piston changes, the volume of respective first and second pump chambers are simultaneously varied. During each piston stroke (movement as indicated by arrow B shown in FIG. 1B) gas volume from the first pump chamber is fed into the second pump chamber. Therefore, it is advantageous to include a flow conduit with a check valve (designated by O-ring 8 and sealing surfaces 9,10) integral with the piston. During the subsequent return movement of the piston,(movement as indicated by arrow A shown in FIG. 1A) the gas in the second chamber is compressed and exhausted. Simultaneously gas is provided to the first chamber through suction valve 12 from a pre-positioned connected container or from the atmosphere.

As previously described, in order to alter the position of piston 2, piston rod 3 is coupled to piston 2 and fed in a vacuum tight manner through the first pump chamber and the first end cap 5. Preferably, the first end cap is securely coupled to the cylindrical pipe. Since the piston does not also operate as the first end cap, this configuration has the distinct safety advantage such that when the vacuum line of the container is vented, the piston is not catapulted out of the cylindrical pipe. If the piston was permitted to exit the pump housing and the system was vented in a relatively quick manner, the piston and piston rod could possibly be ejected from the housing which could result in injuries to an operator or bystander. In addition, if the piston rod was fed through the second chamber, the piston together with the piston rod would be forcibly pushed out of the housing during venting of the vacuum which could also result in a dangerous situation.

In accordance with the operation of the present invention, since the first pump chamber has a lower pressure then the second pump chamber, particular care must be taken to hermetically seal the piston rod in the chamber housing. This is advantageously done with sealing elements, known in the art, in particular, gas pressure springs.

In the preferred embodiment of the present invention, a particularly efficient structure of vacuum pump is provided wherein easy action check valves are installed at the input as well as the output of the pump. These check valves are specifically intake valve 12 and exhaust valve 13. Care should be taken that the least amount of clearance volume is required for opening the valves.

It is particularly advantageous if the exhaust valve 13 of the vacuum pump is capable to couple to pressure hoses for connecting to a variety of devices. Therefore, the vacuum pump can also be used as a pressure pump. Specifically, the vacuum pump can be utilized during recreation activities such as camping as an air pump for filling rafts, balls and bicycle wheels. In view of this expanded range of use of the vacuum pump of the present invention, any increased expense in manufacturing the pump is justified as compared to that of conventional pressure pumps.

It is advantageous to equip the suction opening (intake valve 12) of the first chamber with a fine air filter 15 which can be easily cleaned. This fine air filter prevents the introduction of particles into the vacuum pump which would clog the valves and aggravate the frictionless operation of the piston.

In accordance with the present invention and as described, the piston is equipped with a valve which connects the first pump chamber to the second pump chamber. Here too, check valves may be used. It is advantageous to utilize an O-ring, which releases or closes the flow path depending on the direction of movement of the piston.

In accordance with the present invention, the piston diameter is preferably not larger than 50 mm. Since the manually operated vacuum pump must overcome a relatively high differential pressure, but at the same time provide a force which is not too high for operation by the user. However, the suction volume of the pump should be relatively high so as to sufficiently and quickly remove gas from the container being evacuated with the least amount of actuations. It is therefore advantageous to actuate the pump in accordance with the invention by foot because a greater amount of force is provided and therefore, a larger cross section of the piston can be used. As a result with the same suction volume, the piston stroke can be reduced.

In accordance with the present invention, the vacuum pump can be utilized for evacuation of sorption systems wherein gases are removed by the vacuum pump so that water may be easily brought to evaporation in a vacuum. Suitable sorption systems and sorption substance containers and adapters are known from German patent applications DE 4,243,816 and DE 4,243,817.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A vacuum pump comprising:

a housing containing first and second pump chambers, the first and second pump chambers being defined by interior walls of the housing, first and second end caps and a displaceable piston, the first pump chamber having an inlet opening including a first valve for providing gas to the vacuum pump, the second pump chamber having an outlet opening including a second valve for expelling gas from the vacuum pump, the first and second pump chambers having first and second chamber volumes respectively, the first chamber volume of the first pump chamber and the second chamber volume of the second pump chamber being altered based upon a displacement of the displaceable piston, the displaceable piston being coupled to a piston rod which is fed through one of the first and second chambers and one of the first and second end caps, the first pump chamber being in selectable fluid communication with the second pump chamber, wherein gas that is provided to the vacuum pump is compressed in two stages, initially in the first pump chamber and secondarily in the second pump chamber, and wherein the first pump chamber volume having a maximum value when the displaceable piston is at a point closest to the second end cap, the first chamber volume having a minimal value when the displaceable piston is at a point closest to the first end cap, the second chamber volume representing a chamber volume when the first chamber volume is a minimum value, the second chamber volume representing a clearance volume when the first chamber volume is a maximum value, wherein the vacuum pump is designated such that a ratio of chamber volume to clearance volume is at least 181.

2. A vacuum pump as defined by claim 1 wherein the piston rod is fed through said first pump chamber and wherein the gas that is provided to the vacuum pump is initially provided into the first pump chamber.

3. A vacuum pump as defined by claim 1, wherein said outlet opening includes airtight connection means for coupling the outlet opening of the vacuum pump to a first device so as to provide the gas being expelled from the vacuum pump to the first device.

4. A vacuum pump as defined by claim 1 wherein the inlet opening further includes an air filter.

5. A vacuum pump as defined by claim 1 wherein said piston includes at least one valve means for providing selectable fluid communication between the first pump chamber and the second pump chamber.

6. A vacuum pump as defined by claim 5 wherein said at least one valve means includes at least one O-ring.

7. A vacuum pump as defined by claim 1 wherein each of said interior walls of the housing, said first and second end caps, said displaceable piston and said piston rod are substantially composed of synthetic materials.

8. A method of providing one of a positive pressure and a negative pressure utilizing a vacuum pump, the vacuum pump including a housing containing first and second pump chambers, the first and second pump chambers being defined by interior walls of the vacuum pump, first and second end caps and a displaceable piston, the first pump chamber having an inlet opening including a first valve for providing gas to the vacuum pump, the second pump chamber having an outlet opening including a second valve for expelling gas from the vacuum pump, the first and second chamber volume being altered based upon a displacement of the displaceable piston, the first pump chamber being in selectable fluid communication with the second pump chamber, the first chamber volume having a maximum value when the displaceable piston is at a point closest to the second end cap, the first chamber volume having a minimal value when the displaceable piston is at a point closest to the first end cap, the second chamber volume representing a chamber volume when the first chamber volume is a minimum value, the second chamber volume representing a clearance volume when the first chamber volume is a maximum value, wherein the vacuum pump is designated such that a ratio of chamber volume to clearance volume is at least 181, the method comprising the steps of:

a) supplying gas to the first pump chamber;

b) providing fluid communication between the first chamber volume and the second chamber volume;

c) moving the displaceable piston so as to increase the second chamber volume and decrease the first chamber volume;

d) providing said gas from the first pump chamber to the second pump chamber;

e) isolating the first chamber volume from the second chamber volume so as to eliminate fluid communication in between;

f) moving the displaceable piston so as to increase the first chamber volume and decrease the second chamber volume; and g) attaining a sufficient pressure in the second pump chamber so as to open the second valve of the outlet opening in order to expel the gas from the vacuum pump.

9. A method of providing one of a positive pressure and a negative pressure utilizing a vacuum pump as defined by claim 8, the vacuum pump further including an inlet opening and an outlet opening wherein prior to step (a), the method further comprising:

attaching a sorption system to the inlet opening so that the sorption system is in fluid communication with the vacuum pump, such that the gas that is supplied to the first pump chamber is provided from the sorption system to generate a negative pressure within at least a portion of the sorption system.

10. A vacuum pump comprising:

a housing containing first and second pump chambers, the first and second pump chambers being defined by interior walls of the housing, first and second end caps and a displaceable piston, the first pump chamber having an inlet opening including a first valve for providing gas to the vacuum pump, the second pump chamber having an outlet opening including a second valve for expelling gas from the vacuum pump, the first and second pump chambers having first and second chamber volumes respectively, the first chamber volume of the first pump chamber and the second chamber volume of the second pump chamber being altered based upon a displacement of the displaceable piston, the displaceable piston being coupled to a piston rod which is fed through one of the first and second chambers and one of the first and second end caps, the first pump chamber being in selectable fluid communication with the second pump chamber, wherein gas that is provided to the vacuum pump is compressed in two stages, initially in the first pump chamber and secondarily in the second pump chamber, wherein the second chamber volume represents a chamber volume when the displaceable piston is at a point closest to the first end cap, the second chamber volume representing a clearance volume when the displaceable piston is at a point closest to the second end cap, wherein the vacuum pump is designated such that a ratio of chamber volume to clearance volume is at least 181, and wherein the compression of the gas in the second pump chamber is provided until a sufficient pressure is achieved to open the second valve of the outlet opening and expel the gas from the vacuum pump.

* * * * *